US006056130A

United States Patent [19]

Ovadia

[11] Patent Number: 6,056,130

[45] Date of Patent: May 2, 2000

[54] JEWELRY SUPPORT APPARATUS FOR INSERTION INTO A BASE

[76] Inventor: Joseph Ovadia, 109 Longhill Rd., Little Falls, N.J. 07424

[21] Appl. No.: 09/173,291

[22] Filed: Oct. 14, 1998

[51] Int. Cl.[7] ..... A47F 5/00

[52] U.S. Cl. ..... 211/85.2; 211/13.1; 206/6.1; 206/566

[58] Field of Search ..... 211/85.2, 13.1, 211/205; 206/6.1, 566; 248/176.1

[56] References Cited

U.S. PATENT DOCUMENTS

| | | | |
|---|---|---|---|
| 608,946 | 8/1898 | Adams | 206/566 |
| 1,747,628 | 2/1930 | Hagel | 211/13.1 |
| 1,802,037 | 4/1931 | Smith | 206/6.1 |
| 2,991,876 | 7/1961 | Shiffman | 206/6.1 |
| 3,415,177 | 12/1968 | Abramowitz et al. | 211/13.1 X |
| 3,424,313 | 1/1969 | Feibelman | 211/205 X |
| 3,937,319 | 2/1976 | Roy | 206/6.1 |
| 4,180,169 | 12/1979 | Michels | 211/85.2 |
| 4,282,975 | 8/1981 | Ovadia | 206/566 |
| 5,033,625 | 7/1991 | Campbell | 211/85.2 |
| 5,535,878 | 7/1996 | Reed | 206/6.1 |

*Primary Examiner*—Robert W. Gibson, Jr.
*Attorney, Agent, or Firm*—Sofer & Haroun, LLP

[57] ABSTRACT

A unitarily molded display stand for displaying articles of jewelry is provided, the articles of jewelry having indicia tags. The display stand is insertable into a slot of the display base, the slot having opposing side walls. The display stand is provided with a jewelry support portion, a projection member connected to the jewelry support portion. The projection member has first and second ends which define a space therebetween for receiving the indicia tag and shelf projections mounted on the first and second ends of the projection member, so that when the projection member is inserted into the slot of the display base, the shelf projections frictionally engage the opposing walls of the slot so that the indicia tag is disposed within the slot of the display base. Additionally, the jewelry support portion may be provided with either a semi-circular portion for supporting a ring or a linear member provided with two openings for receiving earrings, a pendant, chain or necklace.

20 Claims, 3 Drawing Sheets

FIG. 1
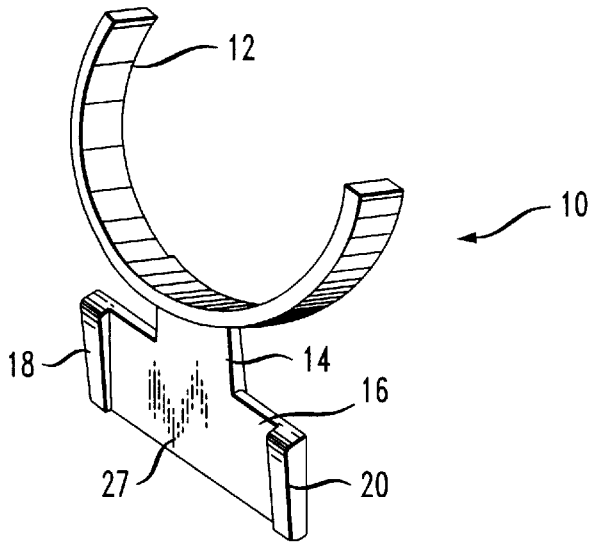
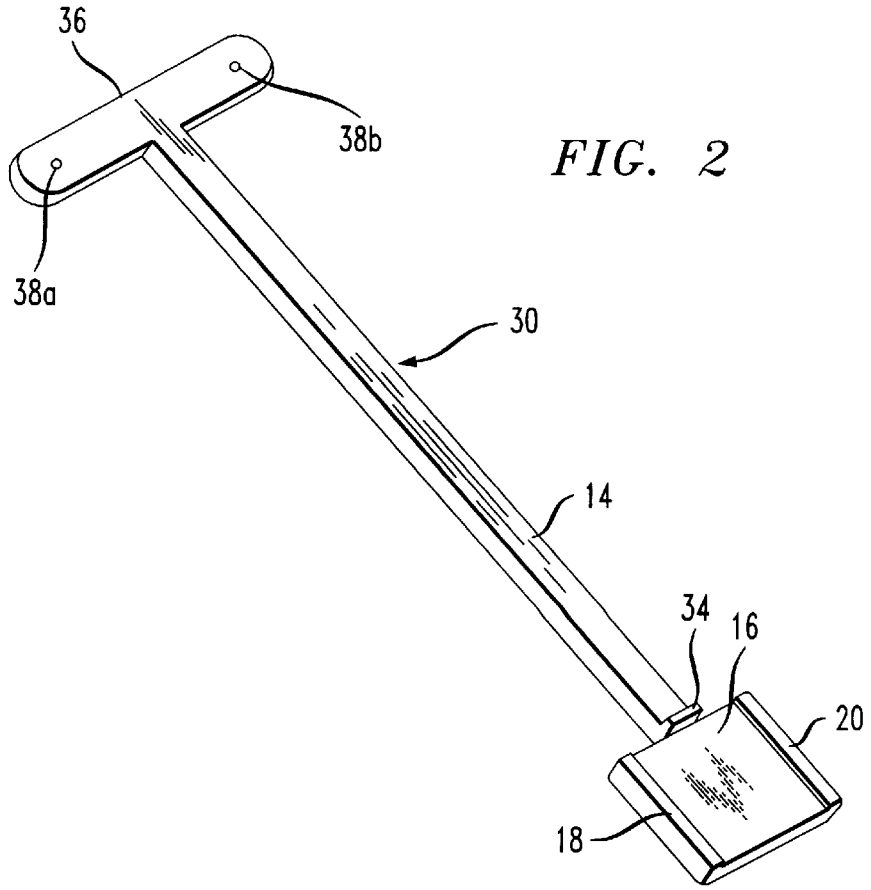
FIG. 2

FIG. 4
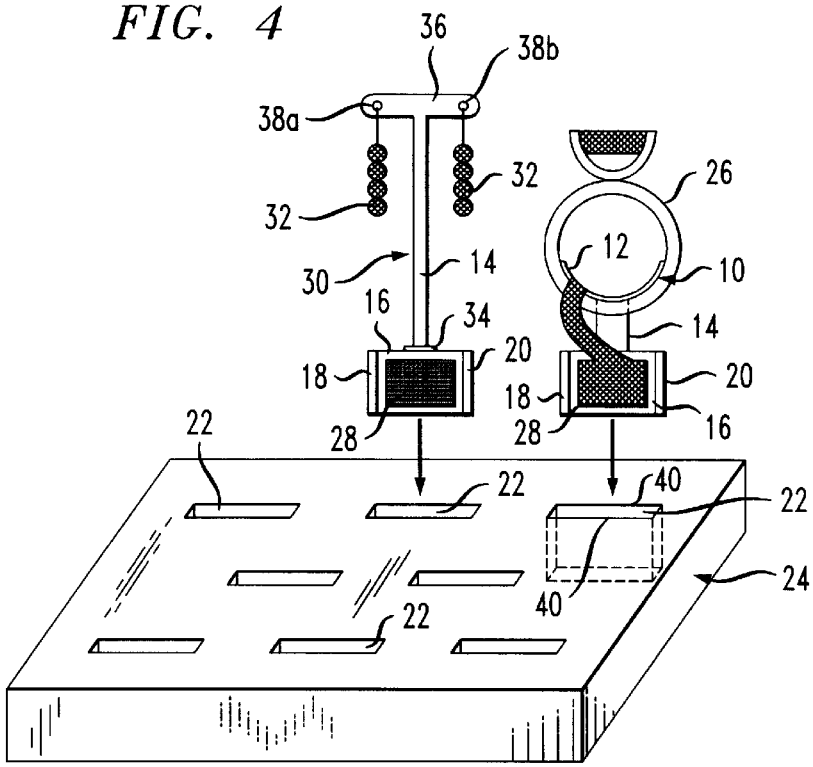
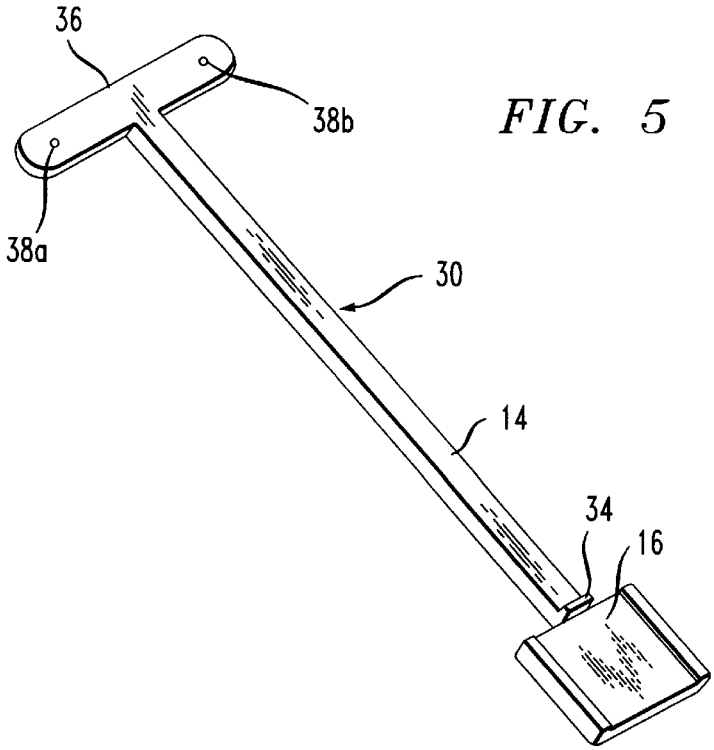
FIG. 5

JEWELRY SUPPORT APPARATUS FOR INSERTION INTO A BASE

FIELD OF THE INVENTION

This invention relates generally to devices for displaying various articles of jewelry, and more particularly, to a display stand for retaining articles of jewelry, the display stand having a projection member with shelf projections for insertion into a jewelry support base.

BACKGROUND OF THE INVENTION

Jewelry articles, particularly rings, can be stored and displayed in a variety of trays, holders or racks. The most common type of jewelry display for rings, described generally in U.S. Pat. No. 4,282,975, comprises a pad, generally of a plush felt or velvet material, which is placed in a tray, preferably of square or rectangular shape. The felt pad which rests within the tray is provided with a plurality of downwardly extending recesses into which a ring is inserted and which are generally configured such that the circular shank or lower portion of a ring is retained in the felt. The tray portion of this type of display is often configured to permit a plurality of trays to be nested upon each in stacked fashion. Other types of display stands comprise generally a base fabricated out of stone or metal, the base having a slot or cut-out into which a display stand is inserted. The display stand has a projection which corresponds in size to the slot. In this fashion, the display stand and the individual item of jewelry may be secured to the base thereby allowing the jewelry item to be freely displayed.

However, rings and other articles of jewelry are often provided with indicia labels or tags that contain important information such as composition, i.e. gold, silver, platinum, etc., weight, price and/or bar codes. Since indicia labels often detract from the beauty of the jewelry being displayed, some jewelers in the trade neglect to attach indicia tags to the jewelry, resorting instead to looking up price, composition and weight information, etc., in an index or price book. This, however, takes time and customers may become impatient while waiting to receive all the information. Jewelers, thus prefer to attach indicia tags directly to the jewelry so as to have immediate access to all information pertaining to that article. It is, however, preferred by those in the jewelry trade to keep such indicia labels out of sight of potential customers since it is hoped that a customer will first be impressed by the ring which they may see in a store window or display case and then be enticed to enter the store to inquire further before seeing the price of the ring.

Prior art display trays, however, do not permit the rings to be stored and displayed while keeping the indicia tag out of sight. The upper surface of the prior art display tray are often provided with outwardly extending tabs which permit only a limited portion of the indicia tag to be inserted underneath the tab. As such, the indicia tab is often left to hang free on the felt. As well, prior art display stands do not permit the jewelry items to be displayed while keeping the indicia tag out of sight.

The prior art display trays have also been found to inadequately secure and retain the jewelry items within the display case, particularly when the trays are moved or transported. Often times since the rings are constantly removed and reinserted from the tabs in the felt upper surface, the salesperson neglects to fully insert the ring into the tab, thus leaving the ring in a virtually unsecured condition.

Accordingly, there is a need for a jewelry display stand employed to display articles of jewelry and which avoids the disadvantages discussed above.

OBJECTS AND SUMMARY OF THE INVENTION

It is accordingly a principal object of the present invention to provide a jewelry display apparatus in the form of a display stand which can be used both for display purposes as well as to secure the indicia label in a neat and orderly appearance.

A more specific object of the present invention is to provide a jewelry display stand unitarily molded from a lightweight plastic material and which has a unitary surface provided with a wedge shaped projection which may be inserted into a slot or cut-out located in a base. The base may be fabricated out of any material such as stone, glass, metal, Lucite or plastic. As is evident to those skilled in the art any type of base material may be utilized.

It is another object of the present invention to provide a jewelry display stand which permits the display of rings or other items of jewelry such as but not limited to earrings, pendants and necklaces arranged thereon in a fashion in which indicia tags attached to the jewelry items are hidden from sight, or inserted into the slot within the base. This allows the presentation of the items of jewelry in a pleasing arrangement.

Another object of the present invention is to provide a plurality of jewelry display stands in which the indicia tags are hidden from sight within the slots in the base, the jewelry display projection having a tapered wedge shape so that the projections may be securely inserted or friction fitted against the interior side walls of the slot while not damaging the indicia label attached to the item of jewelry.

In accordance with one aspect of the present invention, a unitarily molded display stand for displaying articles of jewelry is provided, the articles of jewelry having indicia tags. The display stand is insertable into a slot of the display base, the slot having opposing side walls. The display stand is provided with a jewelry support portion, a projection member connected to said jewelry support portion, the projection member having first and second ends which define a space therebetween for receiving the indicia tag and shelf projections mounted on the first and second ends of the projection member, so that when the projection member is inserted into the slot of the display base, the shelf projections frictionally engage the opposing walls of the slot so that the indicia tag is disposed within the slot of the display base. Additionally, the jewelry support portion may be provided with either a semi-circular portion for supporting a ring or a linear member provided with two openings for receiving earrings, a pendant, chain or necklace.

The above description sets forth rather broadly the more important features of the present invention in order that the detailed description thereof that follows may be understood, and in order that the present contributions to the art may be better appreciated. Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

DETAILED DESCRIPTION OF THE DRAWINGS

In the drawings in which like reference characters denote similar elements throughout the several views:

FIG. 1 illustrates a perspective view of the presently preferred embodiment of an unitarily molded display stand of the present invention illustrating a jewelry display stand designed to accommodate a ring for retention and display on a base unit;

FIG. 2 illustrates a perspective view of a further embodiment of an unitarily molded display stand of the present invention illustrating a jewelry display stand designed to accommodate earrings for retention and display and on a base unit;

FIG. 4 illustrates a perspective view of the display stand and base unit of the presently preferred embodiment of the present invention showing both the ring display stand of FIG. 1 and the earring display stand of FIG. 2; and FIG. 5 illustrates a further embodiment of the jewelry display stand.

DETAILED DESCRIPTION OF THE PRESENTLY PREFERRED EMBODIMENT

Figure 3:
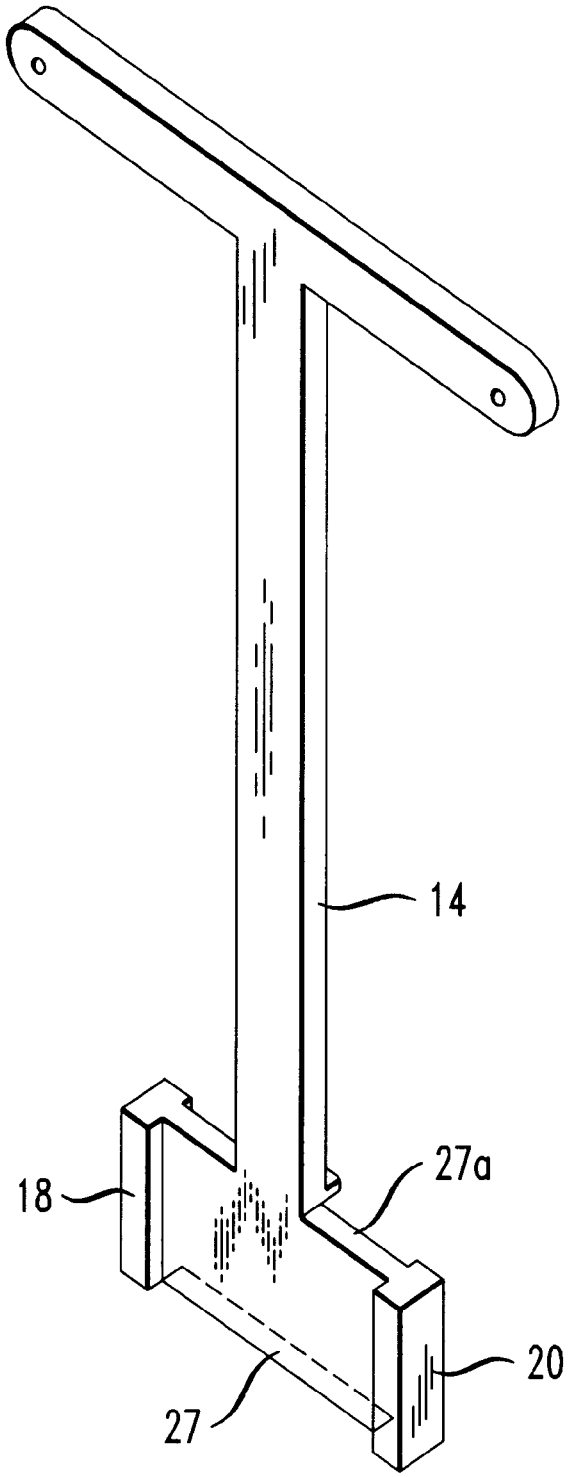
FIG. 3 illustrates a perspective view of a further embodiment of the jewelry display stand designed to accommodate earrings on a base unit, this embodiment showing shelf projections on both sides, and at both ends, of the projection member.

With initial reference to FIGS. 1 and 4, the unitarily molded display stand 10 of the present invention for display of a ring item of jewelry is shown in its preferred embodiment. As illustrated, the ring display stand 10 is preferably comprised of a semi-circular upper portion 12, which is preferably fabricated out of a resilient plastic material so that the semi-circular upper portion may flex to securely retain a ring 26. The semi-circular upper portion 12 is connected at is based to a neck portion 14. Neck portion 14 is connected to projection member 16. Projection member 16 is provided with first and second shelf projections 18, 20 for insertion into a corresponding slot 22 provided in a jewelry support base 24 as shown in FIG. 4. In this way, and with reference to FIG. 4, the shelf projections, which may be tapered or wedge shaped, frictionally secure the ring display stand 10 and the ring 26 secured thereon to the slot 22 located on base 24.

As shown in FIG. 1, shelf projections 18, 20 are shown with a taper, the taper extending away from the semi-circular upper portion 12. Between shelf projections 18, 20, a space 27 is created that preferably does not come into contact with the inner walls 40 of slot 22. In this way and as shown in FIG. 4, an indicia tag 28 may be placed between shelf projections 18, 20 and therefore, indicia tag 28 may be neatly tucked away from view and into slot 22 when the ring 26 is displayed on base 24. With reference to FIG. 3, the shelf projections 18, 20 may extend in both directions relative to projection member 16. Accordingly, two spaces 27, 27*a* may be created on both sides of projection member 16 so that indicia tag 28 may be tucked into either front and/or both spaces 27, 27*a*. With reference to FIG. 5, the earring display stand is shown similar in structure to that of FIG. 2 except for the lack of shelf projections 18 and 20. In this embodiment, projection member 16 is utilized as a label indicia surface so that indicia tag 28 (not shown) may be secured to the projection member 16.

Referring to FIGS. 2 and 4, an earring display stand 30 designed to accommodate earrings 32 to be arranged and displayed on base unit 24 is shown. Similar to the ring display stand 10 described previously, the earring display stand 30 is provided with a neck portion 14, a projection 16 and shelf projections 18, 20. However, unlikely the ring display stand 10, earring display stand 30 is provided with a linear upper member 36 which is substantially perpendicular to neck 30. Linear upper member is also provided with openings 38*a*, 38*b* for receiving earring items of jewelry 32. In this way, when the earrings 32 are secured into openings 38*a*, 38*b* and when the earring display stand 30 is inserted into slot 22 of base 24, the earrings 32 are allowed to hang down toward base 24. Between shelf projections 18 and 20, a space 27 is provided to retain indica tag 28. Although shelf projections 18, 20 are not shown to be tapered in FIG. 2, it is to be understood that shelf projections 18, 20 may or may not be tapered depending on the tightness of fit required by the user of projections 18, 20 against inner walls 40 of slot 22. Earring display stand is also provided with a stop 34 which prevents the earring display stand 30 from being inserted too deeply into slot 22. Although earring display stand 30 is described as supporting earrings 32, it should be understood that any article of jewelry that may be attached utilizing or not utilizing openings 38*a*, 38*b*. For example, it is within the scope of the invention to attach pendants, necklaces, or even chains to such a display stand 30.

It is to be appreciated that although the apparatus of the present invention has been described with reference to retaining, displaying and storing rings and earrings the apparatus may be configured to work equally well with other articles of jewelry such as bracelets, anklets, and watches.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirt of the invention. It is the intention, therefore, to be limited only as indicated by the scope of the claims appended hereto. It is to be understood that the drawings are not necessarily drawn to scale, but that they are merely conceptual in nature.

It is to be understood that the drawings are not necessarily drawn to scale, but that they are merely conceptual in nature.

What is claimed is:

1. A display stand for displaying articles of jewelry having indicia tags, said display stand being insertable into a slot of a display base, said slot having opposing side walls, said display stand comprising:

a jewelry support portion;

a projection member connected to said jewelry support portion, said projection member having first and second ends which define a space therebetween for receiving said indicia tag; and shelf projections mounted on said first and second ends of said projection member, so that when said projection member is inserted into said slot of said display base, said shelf projections engage said opposing walls of said slot so that said indicia tag is disposed within said slot of said display base.

2. The display stand of claim 1, wherein said jewelry support portion further comprises a semi-circular portion for supporting a ring.

3. The display stand of claim 2 wherein said semi-circular portion is fabricated from a resilient plastic material.

4. The display stand of claim 1, wherein said jewelry support portion is a linear member, said linear member provided with two openings for receiving an earring.

5. The display stand of claim 1, wherein said shelf projections are wedge shaped and frictionally engage said opposing side walls of said slot of said display base.

6. The display stand of claim 1, wherein said shelf projections are provided on both sides of said projection member.

7. The display stand of claim 6, wherein said shelf projections are wedge shaped and frictionally engage said opposing side walls of said slot of said display base.

8. The display stand of claim 1, further comprising a stop located between said jewelry support portion and said projection member.

9. The display stand of claim 1, further comprising a neck portion located between said jewelry support member and said projection member.

10. A jewelry support apparatus for displaying articles of jewelry having indicia tags, comprising:

a display base having a slot, said slot having opposing side walls;

a jewelry support portion;

a projection member connected to said jewelry support portion, said projection member having first and second ends which define a space therebetween for receiving said indicia tag; and shelf projections mounted on said first and second ends of said projection member, so that when said projection member is inserted into said slot of said display base, said shelf projections engage said opposing walls of said slot so that said indicia tag is disposed within said slot of said display base.

11. A display stand for displaying articles of jewelry having indicia tags, said display stand being insertable into a slot of a display base, said slot having opposing side walls, said display stand comprising:

a jewelry support portion;

a neck portion connected to said jewelry support portion; and a projection member connected to said neck portion, said projection member having a mounting surface thereon for receiving said indicia tag so that when said projection member is inserted into said slot of said display base, said indicia tag is disposed within said slot of said display base.

12. The display stand of claim 10, wherein said jewelry support portion further comprises a semi-circular portion for supporting a ring.

13. The display stand of claim 10, wherein said jewelry support portion is a linear member, said linear member provided with two openings for receiving an earring.

14. The display stand of claim 10, wherein said shelf projections are wedge shaped and frictionally engage said opposing side walls of said slot of said display base.

15. The display stand of claim 10, wherein said shelf projections are provided on both sides of said projection member.

16. The display stand of claim 10, further comprising a stop located between said jewelry support portion and said projection member.

17. The display stand of claim 10, further comprising a neck portion located between said jewelry support member and said projection member.

18. The display stand of claim 11, wherein said jewelry support portion further comprises a semi-circular portion for supporting a ring.

19. The display stand of claim 11, wherein said jewelry support portion is a linear member, said linear member provided with two openings for receiving an earring.

20. The display stand of claim 11, further comprising a stop located between said jewelry support portion and said projection member.

* * * * *